US009608354B2

(12) United States Patent
Lee et al.

(10) Patent No.: US 9,608,354 B2
(45) Date of Patent: Mar. 28, 2017

(54) JOINT CONNECTOR FOR CONNECTING ELECTRONIC DEVICES IN VEHICLE

(71) Applicants: Hyundai Motor Company, Seoul (KR); Kum Co., LTD, Ulsan (KR)

(72) Inventors: Cheol Hun Lee, Gyeonggi-do (KR); Ju Sung Jeon, Ulsan (KR); Sung Won Jeon, Ulsan (KR)

(73) Assignees: Hyundai Motor Company, Seoul (KR); KUM Co., Ltd., Ulsan (KR)

( * ) Notice: Subject to any disclaimer, the term of this patent is extended or adjusted under 35 U.S.C. 154(b) by 0 days.

(21) Appl. No.: 14/942,799

(22) Filed: Nov. 16, 2015

(65) Prior Publication Data

US 2016/0156119 A1 Jun. 2, 2016

(30) Foreign Application Priority Data

Dec. 2, 2014 (KR) ..... 10-2014-0170194

(51) Int. Cl.
*H01R 13/436* (2006.01)

(52) U.S. Cl.
CPC ..... *H01R 13/4361* (2013.01); *H01R 2201/26* (2013.01)

(58) Field of Classification Search
USPC ..... 439/660, 489, 189, 595, 262, 358
See application file for complete search history.

(56) References Cited

U.S. PATENT DOCUMENTS 5,167,534 A * 12/1992 Ohsumi ..... H01R 13/4362 439/595
5,356,302 A * 10/1994 Inoue ..... H01R 31/085 439/189
5,741,147 A * 4/1998 Konoya ..... H01R 31/08 439/189
6,302,734 B1 * 10/2001 Ichio ..... H01R 13/5208 439/274
6,358,102 B1 * 3/2002 Fukamachi ..... H01R 13/4362 439/752
6,527,583 B2 * 3/2003 Plate ..... H01R 13/4362 439/157
6,616,481 B2 * 9/2003 Ichio ..... H01R 13/4361 439/595
6,786,756 B2 * 9/2004 Mase ..... H01R 13/6275 439/271
2013/0052866 A1 * 2/2013 Il ..... H01R 13/6581 439/607.41

FOREIGN PATENT DOCUMENTS

JP 1996-078084 A 3/1996
JP 1996-288029 A 11/1996
(Continued)

*Primary Examiner* — Alexander Gilman
(74) *Attorney, Agent, or Firm* — Mintz Levin Cohn Ferris Glovsky and Popeo, P.C.; Peter F. Corless

(57) ABSTRACT

A joint connector includes: a connector housing formed with a plurality of terminals that receive a plurality of sockets to which wirings are connected; and a holder that is fitted into the connector housing and electrically connects the sockets which are inserted into the terminals, respectively. Also, a plurality of fitting pieces are inserted into connection portions of the sockets, respectively, which are arranged inside the terminals so as to protrude in a length direction on an inner side of the holder.

6 Claims, 4 Drawing Sheets

(56) References Cited

FOREIGN PATENT DOCUMENTS

| | | | |
|---|---|---|---|
| JP | 2675477 | B2 | 11/1997 |
| JP | 2861661 | B2 | 2/1999 |
| JP | 2002-075507 | A | 3/2002 |
| JP | 2006-100183 | A | 4/2006 |
| JP | 2006-108050 | A | 4/2006 |
| KR | 20-0417442 | Y1 | 5/2006 |
| KR | 10-2009-0073878 | A | 7/2009 |
| KR | 10-2014-0036035 | A | 3/2014 |

* cited by examiner

JOINT CONNECTOR FOR CONNECTING ELECTRONIC DEVICES IN VEHICLE

CROSS-REFERENCE TO RELATED APPLICATION

This application claims under 35 U.S.C. §119(a) the benefit of Korean Patent Application No. 10-2014-0170194 filed on Dec. 2, 2014, the entire contents of which are incorporated herein by reference.

BACKGROUND (a) Technical Field

The present disclosure relates to a joint connector, and more particularly, to a joint connector in which a number of components is reduced to improve workability and performance, and simplify an assembly procedure.

(b) Description of the Related Art

Generally, several electronic devices are installed on each part of a vehicle to promote safe driving of the vehicle, and a circuit is provided on each electronic device so as to supply electric power thereto or control thereof. In particular, as shown in FIG. 1 (PRIOR ART), a joint connector 1 is necessary for connecting each electronic device to a power source or a ground connection.

In each end of the joint connector 1, a joint housing and a wiring harness are connected through a bus bar.

Accordingly, as shown in FIG. 1, a male connector and a female connector are connected each other so that a space between terminals 5 provided between the male connector and the female connector, respectively, is connected electrically, where a plurality of terminals are provided on the connector.

Meanwhile, a plurality of wirings 6 each having a socket are inserted into the terminals 5 of the female connector 3, and the wirings 6 are fixed to the female connector 3 through a holder 8 that is fastened to a rear end thereof, and the female connector 3 is inserted into the male connector 2 having the bus bar 4 to be fitted therein.

Referring to an assembly procedure of the structure of a joint connector described above, as shown in FIG. 2 (PRIOR ART), several steps are required in the assembly procedure, as follows: (a) a wiring harness 9 is formed by pushing sockets 7 of the wirings 6 into the terminals 5 from a rear side of the female connector 5 and gathering a plurality of wirings 6; (b) a female connector 3 is assembled by inserting the holder 8 into a lower side of the female connector 3 such that the sockets 7 are prevented from being separated; and (c) the female connector 3 is inserted into the male connector 2 having the bus bar 4 such that each socket of the bus bar 4 is inserted into the terminal 5 of the female connector 3 to be connected to the socket 7 of the wiring 6.

Meanwhile, a joint connector conventionally applied to a vehicle is provided with a bus bar that is connected to each terminal inside the joint terminal such that the joint connector serves to divide current from one circuit into a plurality of circuits or integrate current from a plurality of circuits into one circuit.

Accordingly, a joint connector has to be used so as to divide or integrate circuits in a whole wiring harness, which increases the number of components for connecting the joint connector, thereby increasing the cost and complexity of the assembly procedure.

The above information disclosed in this Background section is only for enhancement of understanding of the background of the invention and therefore it may contain information that does not form the prior art that is already known in this country to a person of ordinary skill in the art.

SUMMARY

The present invention provides a joint connector in which a bus bar is provided inside a holder of the connector at a side of a female connector so that the joint connector simultaneously functions as a general connector and a joint connector, thereby reducing the number of components, cost and weight thereof.

In one aspect, the present invention provides a joint connector including: a connector housing formed with a plurality of terminals configured to receive a plurality of sockets to which wirings are connected; and a holder that is fitted into a lower side surface of the connector housing and electrically connects the sockets which are inserted into the terminals of the connector housing, respectively, and further including a plurality of fitting pieces that are inserted into connection portions of the sockets, respectively, which are arranged inside the terminals so as to protrude in a length direction on an inner side of the holder.

Further, according to the present invention, a joint connector can include: a connector housing formed with a plurality of terminals configured to receive a plurality of sockets to which wirings are connected; a holder that is fitted into a lower side surface of the connector housing and electrically connects the sockets which are inserted into the terminals of the connector housing, respectively; and a plurality of fitting pieces inserted into connection portions of the sockets, respectively, which are arranged inside the terminals so as to protrude in a length direction on an inner side of the holder.

Other aspects and preferred embodiments of the invention are discussed infra.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
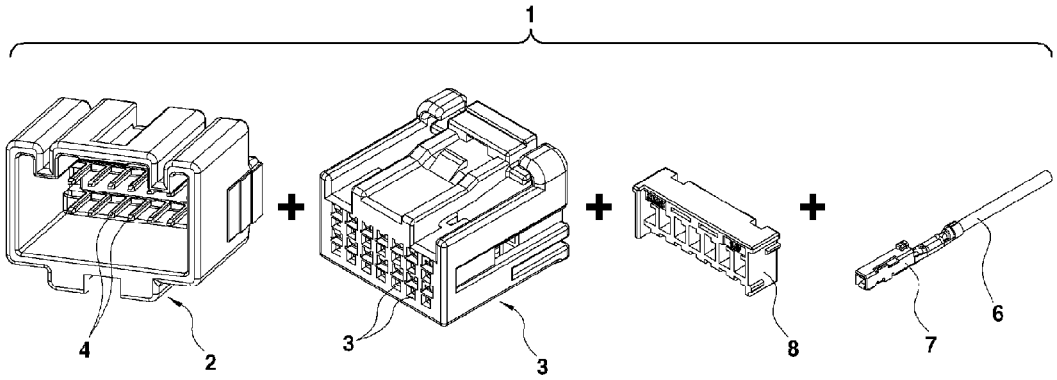
FIG. 1 (PRIOR ART)
FIG. 1 (PRIOR ART) is a perspective view illustrating components of a conventional joint connector.
Figure 2:
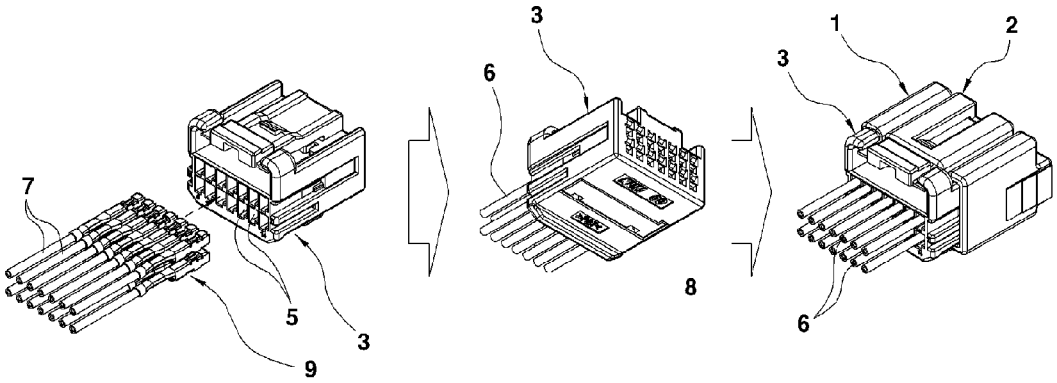
FIG. 2 (PRIOR ART)
FIG. 2 (PRIOR ART) is a perspective view of an assembly procedure of the conventional joint connector of FIG. 1.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present invention may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Figure 3:
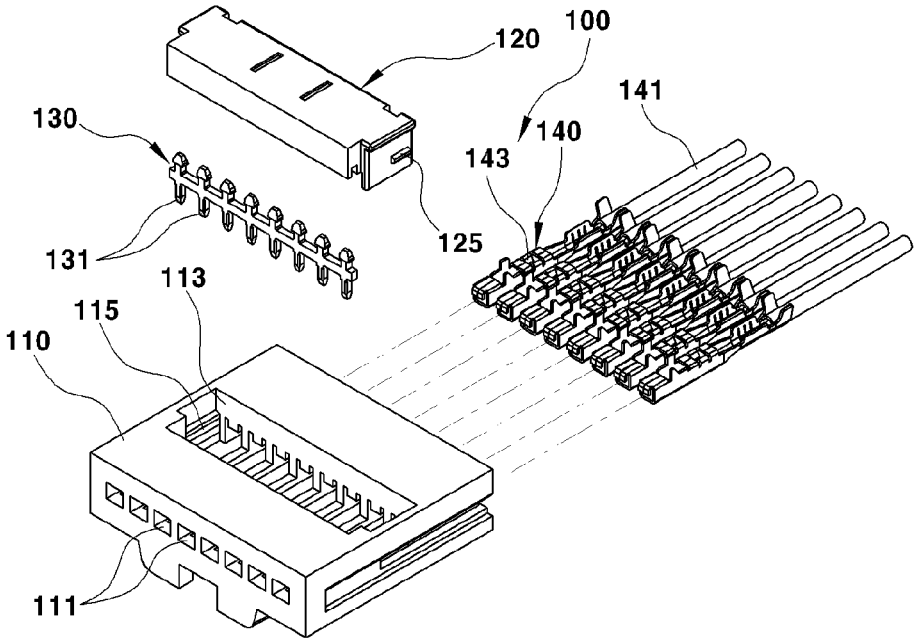
FIG. 3 is a perspective view illustrating components of a joint connector according to the present invention.
Figure 4:
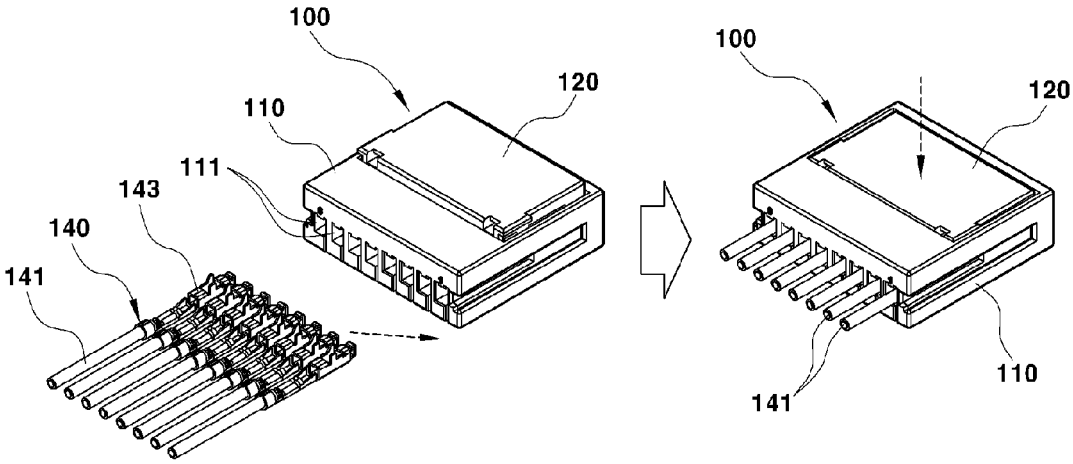
FIG. 4 is a perspective view illustrating an assembly state of the joint connector of FIG. 3.
Figure 5A:
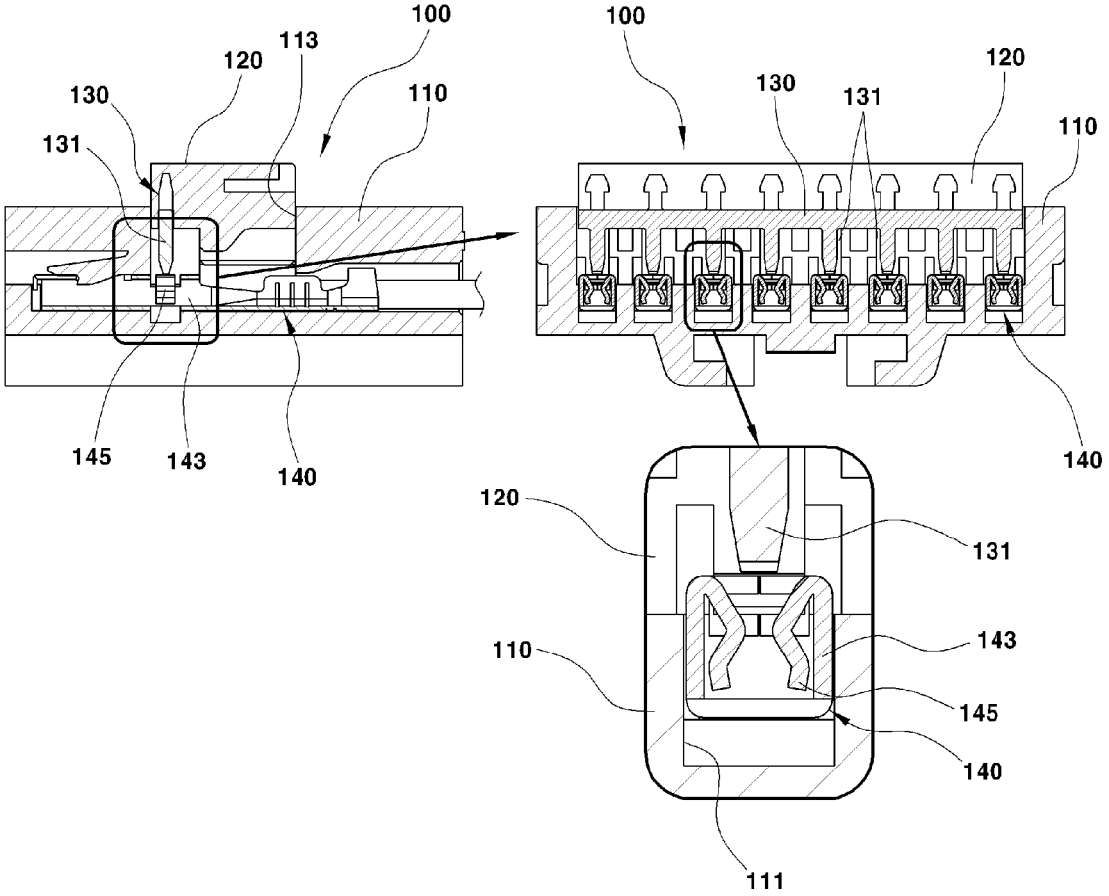
FIGS. 5(*a*) and 5(*b*) are cross-sectional views of the assembly state of the joint connector of FIG. 3.
Figure 5B:
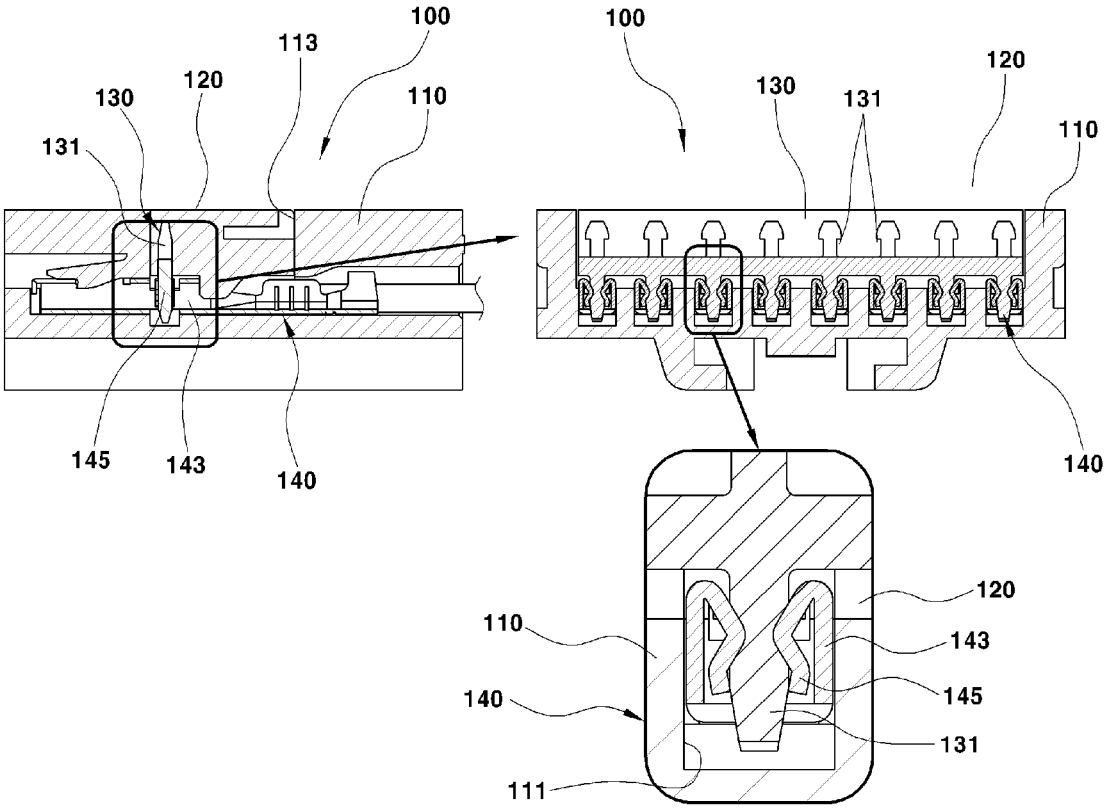

A joint connector 100 of the present invention is provided with a connector housing 110 formed with a plurality of terminals 111 into which a plurality of sockets 140 each connected to a wiring 141 are inserted, as shown in FIGS. 3, 4, and 5A-5B. In particular, the terminals 111 are configured to receive the sockets 140, each of the sockets 140 being connected to a respective wiring 141.

The joint connector 100 may include a holder 120 that is fitted into a lower side surface of the connector housing 110 and electrically connects all of the sockets 140 which are inserted into the terminals 111, respectively.

Further, a plurality of fitting pieces 131 that are inserted into connection portions 143 of the sockets 140, respectively, which are arranged inside the terminals 111 are formed to protrude in a length direction on an inner side of the holder 120, and a metallic bus bar 130 is further provided. For example, the plurality of fitting pieces 131 may be arranged on the metallic bus bar 130.

An elastic piece 145 preferably is formed on both sides of the connection portion 143 such that the fitting piece 131 is not separated by elastic connection through the insertion of the fitting piece 131, and a connection groove 115 is further formed on the fitting piece 131, corresponding to the elastic piece 145.

In addition, a connection groove 115 is formed to protrude on an opening portion 113 of the connector housing 110 such that the connected holder 120 is not to be separated, and a connection protrusion 125 may be formed on one side of the holder 120, which is connected correspondingly to the connection groove 115.

Additionally, the metallic bus bar 130 may be formed integrally on the holder 120 through an insert-ejection.

According to the joint connector as described above, since the joint connector satisfies simultaneously a function of a general connector, the number of components is decreased such as deleting a male connector housing, thereby saving cost and reducing overall weight, as compared to a conventional connector.

Further, according to the joint connector of the present invention, the bus bar contact portion of an elastic structure is provided inside the socket to form integrally the holder and the bus bar, thereby minimizing the increase of insertion force and connecting easily them, as compared to a conventional joint connector.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. A joint connector, comprising:

a connector housing formed with a plurality of terminals configured to receive a plurality of sockets to which wirings are connected;

a holder that is fitted into a lower side surface of the connector housing and electrically connects the sockets which are inserted into the terminals of the connector housing, respectively; and a plurality of fitting pieces that are inserted into connection portions of the sockets, respectively, which are arranged inside the terminals so as to protrude in a length direction on an inner side of the holder, wherein the plurality of fitting pieces are arranged on a metallic bus bar, and the metallic bus bar is formed integrally on the holder through an insert-ejection.

2. The joint connector of claim 1, wherein an elastic piece is formed on both sides of the connection portion such that the fitting piece is not separated by elastic connection through the insertion of the fitting piece, and a connection groove is further formed on the fitting piece, corresponding to the elastic piece.

3. The joint connector of claim 1, wherein a connection groove is formed to protrude on an opening portion of the connector housing such that the holder is not separated, and a connection protrusion is formed on one side of the holder, which is connected correspondingly to the connection groove.

4. A joint connector, comprising:

a connector housing formed with a plurality of terminals configured to receive a plurality of sockets to which wirings are connected;

a holder that is fitted into a lower side surface of the connector housing and electrically connects the sockets which are inserted into the terminals of the connector housing, respectively; and a metallic bus bar that is formed integrally on the holder through an insert-ejection, wherein the metallic bus bar has a plurality of upper fitting pieces and a plurality of lower fitting pieces, the upper fitting pieces are inserted into the holder to be integrally formed on the holder, the lower fitting pieces are inserted into connection portions of the sockets, respectively, which are arranged inside the terminals, and the plurality of the upper fitting pieces and the plurality of the lower fitting pieces protrude in a length direction on the metallic bus bar.

5. The joint connector of claim 4, wherein an elastic piece is formed on both sides of the connection portion such that the fitting piece is not separated by elastic connection through the insertion of the fitting piece, and a connection groove is further formed on the fitting piece, corresponding to the elastic piece.

6. The joint connector of claim 4, wherein a connection groove is formed to protrude on an opening portion of the connector housing such that the holder is not separated, and a connection protrusion is formed on one side of the holder, which is connected correspondingly to the connection groove.

* * * * *